US005560104A

United States Patent [19]

Bruggers et al.

[11] Patent Number: 5,560,104

[45] Date of Patent: Oct. 1, 1996

[54] SHAVER WITH RECIPROCATING DRIVE

[75] Inventors: Jan W. Bruggers, Horst, Netherlands; Stephan Leitner, Kappel, Austria

[73] Assignee: U.S. Philips Corporation, New York, N.Y.

[21] Appl. No.: 326,439

[22] Filed: Oct. 20, 1994

[30] Foreign Application Priority Data

Oct. 21, 1993 [AT] Austria ..... 2128/93

[51] Int. Cl.[6] ..... B26B 19/04

[52] U.S. Cl. ..... 30/43.92; 30/346.51

[58] Field of Search ..... 30/43.92, 34.1, 30/210, 216–220, 220, 346.51

[56] References Cited

U.S. PATENT DOCUMENTS

| | | | |
|---|---|---|---|
| 2,668,351 | 2/1954 | Andis et al. | 30/210 |
| 4,133,104 | 1/1979 | Ascoli | 30/43.92 |
| 4,395,821 | 8/1983 | Schweingruber | 30/218 |
| 5,131,148 | 7/1992 | Wahl | 30/346.51 |

FOREIGN PATENT DOCUMENTS 2747383 5/1978 Germany .

*Primary Examiner*—Douglas D. Watts
*Attorney, Agent, or Firm*—Ernestine C. Bartlett

[57] ABSTRACT

A hair-cutting apparatus (1) is provided with a first cutter (10;6) and second cutter (12; 43) and in which are resiliently urged in a pressing direction (15), with a drive member (19) for driving the second cutter (12), and with a hinge device (20) between the drive member (19) and the second cutter (12; 43), the hinge device (20) comprises two limbs (21, 22) which are oppositely inclined relative to the pressing direction (15) and which are each connected to the drive member (19) and the second cutter (12) by a hinge (23, 24, 25, 26), the two connecting lines (27, 28) through the two hinges (23, 25 and 24, 26, respectively) of each of the limbs (21, 22) intersecting one another substantially in the area of the point of application (29) of the resultants of the frictional forces between the two cutters (10, 12).

7 Claims, 3 Drawing Sheets

SHAVER WITH RECIPROCATING DRIVE

FIELD OF THE INVENTION

The invention relates to a hair-cutting apparatus having a first cutter and second cutter which is reciprocatingly drivable parallel to a driving direction, the first cutter and the second cutter being urged against one another parallel to a pressing direction, having a reciprocatingly drivable drive member for driving the second cutter, and having a hinge device between the drive member and the second cutter, via which hinge device a driving force can be transmitted from the drive member to the second cutter, substantially in the area of the point of application of the resultants of the frictional forces between the two cutters.

BACKGROUND OF THE INVENTION

An apparatus of the type defined in the opening paragraph is known, for example from DE 27 47 383 A1. The known apparatus is a shaving apparatus for cutting facial hairs. The first cutter of said shaving apparatus is formed by an arcuately mounted shear foil and the second cutter is formed by a lamellar cutter comprising steel blades embedded in an arched plastics part. The drive member is formed by a drive pin having a partly spherical head at its free end. This head engages an undercut cylindrical recess in the plastics part of the lamellar cutter. The head and the recess form a joint for the transmission of the driving force from the drive pin to the lamellar cutter. In order to ensure that the head transmits the driving force within the closest possible range of the point of application of the resultants of the frictional forces between the shear foil and the lamellar cutter, the driving pin should be comparatively long and its head should project deep into the interior of the arched plastics part of the lamellar cutter in order to act on this plastics part as near as possible to the blades which cooperate with the shear foil. These requirements impose an undesirable restriction on the construction and in many cases can be met only with great difficulty or not at all. With such a construction it is, for example, not possible to drive the reciprocatingly drivable toothed cutter of a toothed cutting device having two associated flat toothed cutters in such a manner that the driving force is transmitted in the area of the point of application of the resultants of the frictional forces between the two toothed cutters because this point of application is situated in the area of the two associated contact surfaces of the two flat toothed cutters and a spherical head of a drive pin cannot extend into this area of the contact surfaces.

SUMMARY OF THE INVENTION

An object of the invention is to mitigate the above problems and to provide a hair-cutting apparatus which does not impose such restrictions on the construction of the apparatus, particularly of the drive member and the cutter to be driven by this drive member, as in the apparatus known from DE 27 47 383 A1. To this end the invention is characterized in that the hinge device comprises two limbs which are oppositely inclined relative to the pressing direction and which are each connected to the drive member and the second cutter by hinges, and in that the two connecting lines through the two hinges of each of the limbs intersect one another substantially in the area of the point of application of the resultants of the frictional forces between the two cutters. Thus, it is achieved with very simple means that by a suitable choice of the inclination of the inclined limbs between the drive member and the second cutter, the point of application for the driving force, which is situated essentially in the point where the two connecting lines through the two hinges of each limb intersect, can be adapted very accurately or approximated very closely to the point of application of the resultants of the frictional forces between the two cutters of a haircutting apparatus in accordance with the invention, yet providing comparatively great freedom as regards the construction of, in particular, the drive member and the drivable cutter substantially without any restrictions. Moreover, this has the advantage that also in the case of a toothed cutting device comprising two flat toothed cutters in contact with one another the driving force can be transmitted exactly in the area of the point of application of the resultants of the frictional forces between the two toothed cutters via a hinge device of a construction in accordance with the invention.

In a hair-cutting apparatus in accordance with the invention in which the second cutter has a cutter holder, preferably if the cutter holder, the two limbs and the drive member are formed integrally from a plastic material, and the hinges are integral hinges. This is advantageous for a construction with a minimal number of parts and for a simple assembly. Another advantage resides in the possibility of miniaturizing such a construction and in the fact that the hinge device couples the cutter holder and the drive member to one another without any lost motion.

To ensure a satisfactory engagement of the first cutter and the second cutter, which are urged against one another in a direction parallel to the pressing direction, the first cutter may be urged against the second cutter, for example, by spring force. However, it is preferred if, in addition to being reciprocatingly movable, the drive member is also mounted to be movable parallel to the pressing direction and is urged towards the first cutter by means of at least one spring. This has proved to be advantageous for a satisfactory engagement of the two cutters and also for a particularly simple construction.

A spring which urges the drive member towards the first cutter may act directly on the drive member. However, it is particularly preferred that the spring acts on the cutter holder and on a stationary bearing element. This is advantageous for a very intimate and stable engagement of the two cooperating cutters with one another.

It is also preferred that the drive member is formed by a drive lever which is pivotable relative to a stationary bearing element by means of a pivotal bearing device, and in that the pivotal bearing device comprises a further limb which extends substantially perpendicularly to the pressing direction and which is pivotally connected to a part of the stationary beating element and to the drive lever via each time one hinge. This is advantageous for a particularly simple movable arrangement of the drive member as well as the drivable cutter connected to it by the limbs.

It is further preferred that the drive lever and the further limb as well as the part of the stationary beating element form an integral plastics part and the two hinges are integral hinges. This results in a very simple construction with a minimal number of parts, which is advantageous for a simple assembly. Another advantage is that this construction has no lost motion, which is beneficial for a minimal noise production.

BRIEF DESCRIPTION OF THE DRAWINGS

The invention will now be described in more detail with reference to two exemplary embodiments to which the invention is not limited.

DETAILED DESCRIPTION OF THE PREFERRED EMBODIMENTS

Figure 1:
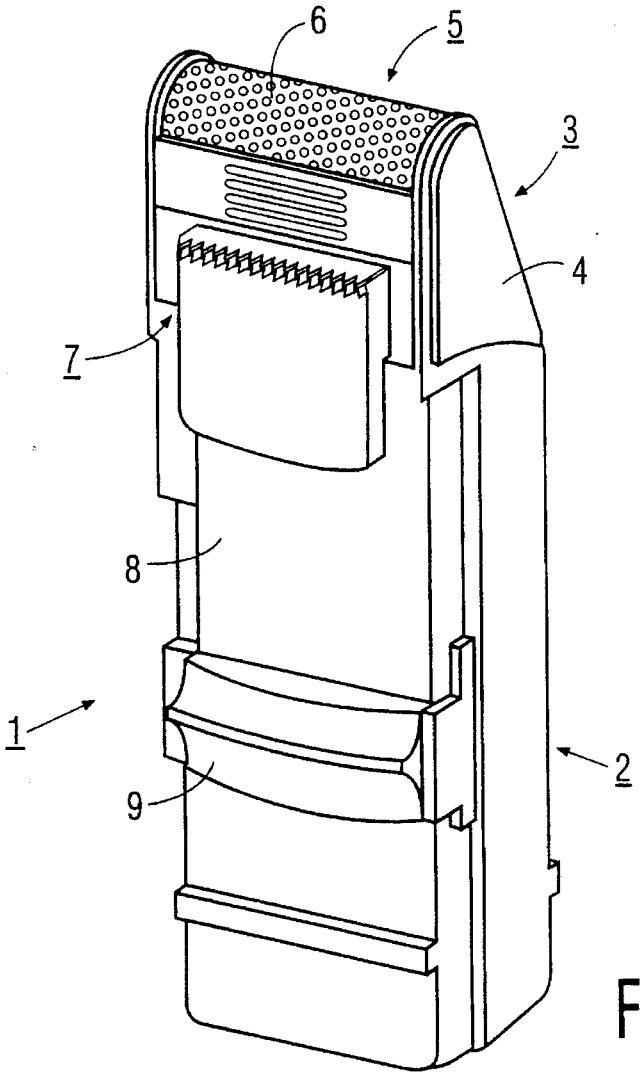
FIG. 1 is an oblique view of a shaving apparatus in accordance with a first embodiment of the invention comprising a short-hair cutting device and a long-hair cutting device.

FIG. 1 shows a shaving apparatus 1 having a housing 2 on which a shaving head 3 is mounted. The shaving head 3 comprises a shaving-head frame 4 in which a short-hair cutting device 5 for cutting facial hairs is mounted. The short-hair cutting device 5 basically comprises an arched shear foil 6 and a lamellar cutter which is not shown in FIG. 1 and which is resiliently urged into the interior of the arched shear foil 6. The shaving apparatus 1 further comprises a long-hair cutting device formed by a toothed cutting device 7 for cutting long facial hairs as well as the hairs of the head. The toothed cutting device 7 is mounted at the location of a side wall 8 of the housing 2 so as to be movable in the longitudinal direction of the apparatus 1 between a rest position shown in FIG. 1 and an operating position not shown in FIG. 1, which operating position is situated closer to the short-hair cutting device 5. The apparatus 1 has a slider 9 for moving the toothed cutting device 7.

Figure 2:
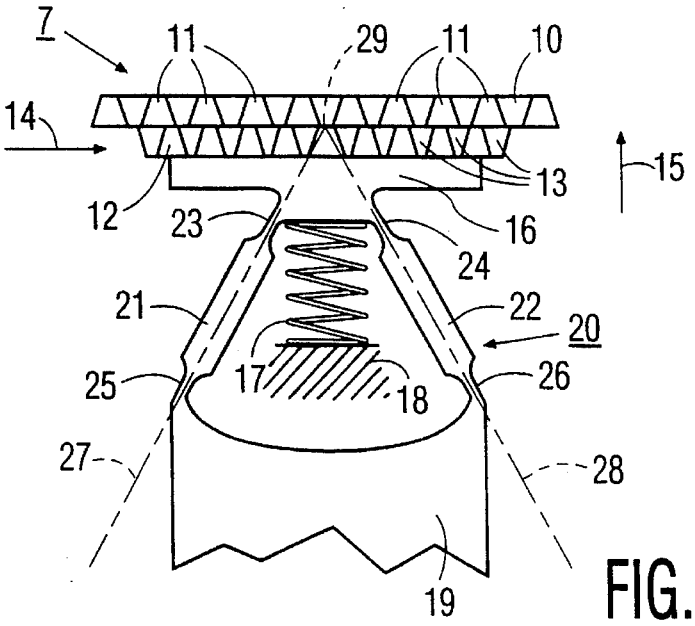
FIG. 2 shows diagrammatically a long-hair cutting device, as used in the apparatus shown in FIG. 1 and constructed as a toothed cutting device with two toothed cutters, and the relevant part of a driving device for the drivable toothed cutter of the toothed cutting device.

FIG. 2 shows diagrammatically the toothed cutting device 7 of the apparatus shown in FIG. 1. The toothed cutting device 7 has a first cutter 10 constructed as a toothed cutter comprising a row of cutter teeth 11 and stationarily mounted on a support, not shown, for the entire toothed cutting device 7. The toothed cutting device further comprises a second cutter 12 which is also constructed as a toothed cutter comprising a row of cutter teeth 13 and which is reciprocatingly drivable by a driving device parallel to a driving direction indicated by an arrow 14. The first cutter 10 and the second cutter 12 are pressed against one another parallel to a pressing direction indicated by a further arrow 15. The second cutter 12 is supported by a cutter holder 16 which is acted upon by a pressure spring 17 which bears against a stationary abutment 18 on the support for the entire toothed cutting device 7. The two rows of cutter teeth 11 and 13 of the toothed cutters 10 and 12 have a different tooth pitch.

A reciprocatingly drivable drive member 19 has been provided driving the second cutter 12 and is, for example, formed by a pivotable drive lever. A hinge device 20 is arranged between the drive member 19 and the second cutter 12 or the cutter holder 16 carrying the second cutter 12, via which hinge device a driving force can be transmitted from the drive member 19 to the second cutter 12, substantially in the area of the point of application of the resultants of the frictional forces between the two cutters 10 and 12.

As is shown in FIG. 2, the hinge device 20 comprises two limbs 21 and 22 which are oppositely inclined relative to the pressing direction 15 and which are each connected to the drive member 19 and the second cutter 12 by hinges 23 and 24 and hinges 25 and 26, respectively, in the present case via the cutter holder 16. The two connecting lines 27 and 28 through the two hinges 23, 25 and 24, 26 of each of the limbs 21 and 22, respectively, intersect one another in the area of the point of application 29 of the resultants of the frictional forces between the two cutters 10 and 12. The point of application of the resultants of the cutting forces between the two cutters 10 and 12 is also situated in the area of the point of application 29 of the resultants of the frictional forces. Owing to the flat construction the point of application of the resultants of the inertial forces of the drivable cutter 12 and the cutter holder 16 is situated very close to the point of application 29 of the resultants of the frictional forces.

As a result of this construction, no unfavourable torque effects act on the drivable cutter 12 when this cutter is driven and result in the contact face of the drivable cutter 12 being lifted at least partly off the contact face of the stationary cutter 10, so that always a satisfactory and close engagement between the two cutters 10 and 12 under the influence of the spring 17 is guaranteed. The construction of the hinge device 20 by means of the inclined limbs 21 and 22 has the advantage that by a suitable choice of the inclination of the limbs 21 and 22 the driving force transmitted to the drivable cutter 12 by the drive member 19 can be situated very accurately in the area of the point of application 29 of the resultants of the frictional forces between the two cutters 10 and 12.

The cutter holder 16, the two limbs 21 and 22, and the drive member 19 form an integral plastic part, the limbs 23, 24, 25 and 26 being constructed as integral hinges. This results in a construction with a minimal number of parts, which simplifies the assembly process during the manufacture of the apparatus. It also yields a construction without lost motion.

Figure 3:
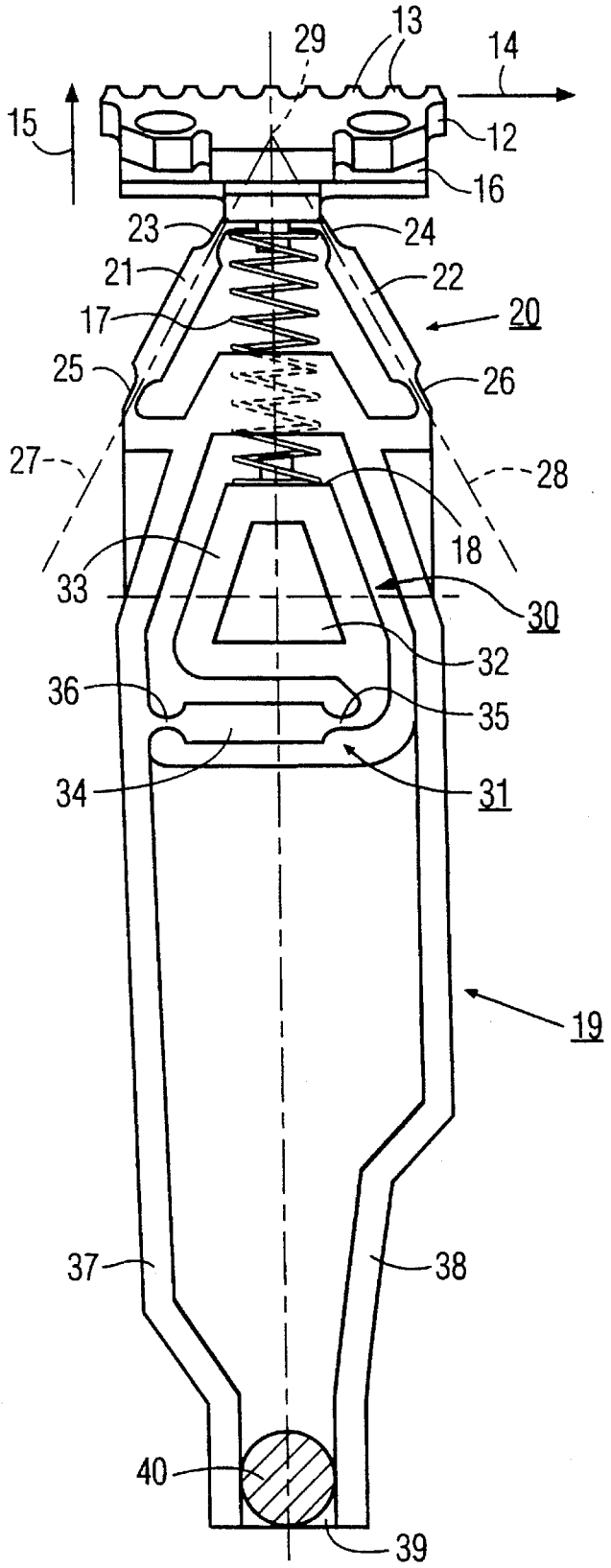
FIG. 3 shows a modified construction for a drive lever for driving a drivable toothed cutter supported by a cutter holder and forming part of a toothed cutting device as shown diagrammatically in FIG. 2.

FIG. 3 shows a practical variant for the construction of a drive lever 19 for driving a drivable toothed cutter 12 carried by a cutter holder 16 of a toothed cutting device 7, as shown diagrammatically in FIG. 2. As already described with reference to FIG. 2, the drive lever 19 is connected to the cutter holder 16 via the hinge device 20, to which holder the reciprocatingly drivable cutter 12 is secured. Apart from its ability to reciprocate the drive lever 19 is capable of movement parallel to the pressing direction 15 and is urged towards the stationary first cutter 10, not shown in FIG. 3, by means of the pressure spring 17. The pressure spring 17 acts on the cutter holder 16 and on the stationary abutment 18.

The pivotable drive lever 19 is mounted so as to be pivotable relative to a stationary bearing element 30 by means of a pivotal bearing device 31. The stationary bearing element 30 comprises a trapezoidal bearing pin 32, which projects from the support, not shown, for the entire toothed cutting device, and a trapezoidal bearing ring 33 which is pressed onto this bearing pin 32 and whose ring portion nearest the two cutters 10 and 12 forms the abutment 18 for the pressure spring 17. The pivotal bearing device 31 comprises a further limb 34 which extends substantially perpendicularly to the pressing direction 15 and which is connected to the bearing ring 33 of the stationary bearing element 30 and to drive lever 19 via a hinge 35 and a hinge 36, respectively. The drive lever 19 and the further limb 34 as well as the bearing ring 33 of the stationary bearing element form an integral plastic part, the two hinges 35 and 36 being integral hinges.

This construction ensures a satisfactory cooperation between the two cutters 10 and 12 of the toothed cutting device 7 and is also particularly simple. The above construction of the pivotal bearing device 31 ensures that the drive lever 19 has no lost motion, which is beneficial for a minimal noise production while the drive lever 19 is driven.

The drive lever 19 has two lateral ribs 37 and 38. At the location of the end 39 of the drive lever 19, which end is remote from the two cutters 10 and 12, a drive pin 40 extends between the two ribs 37 and 38 of the drive lever 19 and is drivable by a driving device to pivot the drive lever 19 to and fro and, as a consequence, move the cutter 12 with a reciprocating motion. In addition to being pivoted the drive lever 19 is slightly reciprocated parallel to the pressing direction 15 during driving of the drive lever 19, the integral hinges 35 and 36 providing the movability of the drive lever 19 parallel to the pressing direction 15 and at the same time the possibility to perform a reciprocating movement. When the drive lever 19 is driven the hinges 23, 24, 25 and 26 further provide compensation for an oblique position of the drivable cutter 12 relative to the stationary cutter 10, so that the contact face of the drivable cutter 12 remains always in close engagement with the contact face of the stationary cutter 10, thereby ensuring a correct cutting of hairs.

Figure 4:
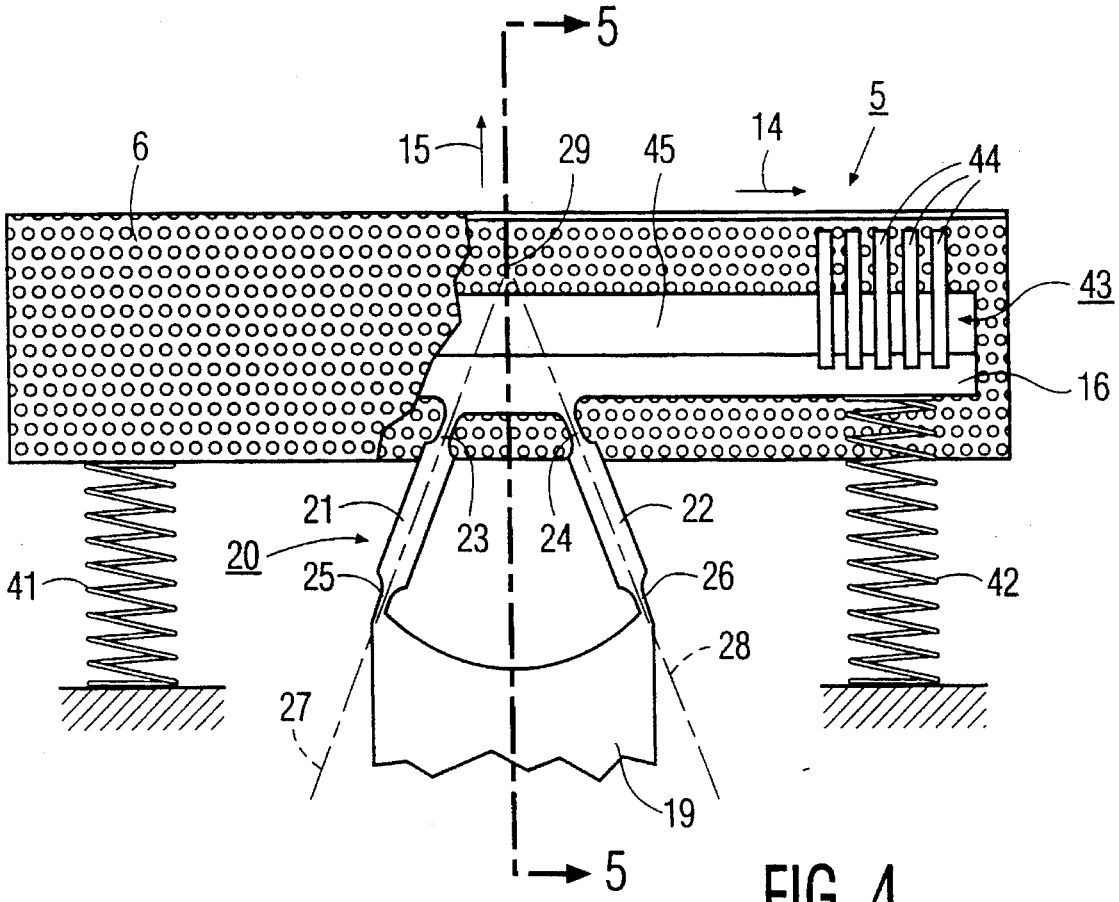
FIG. 4 is a diagrammatic side view of the long side of a short-hair cutting device of a shaving apparatus in a second embodiment of the invention, which device comprises a shear foil and a lamellar cutter, and the relevant part of a driving device for the lamellar cutter.
Figure 5:
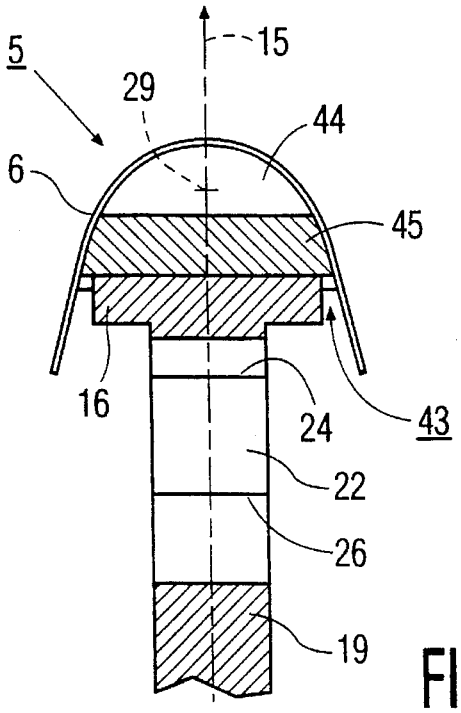
FIG. 5 shows the short-hair cutting device in a diagrammatic sectional view taken on the line V—V in FIG. 4.

FIGS. 4 and 5 show a short-hair cutting device 5 of a shaving apparatus whose other parts are not shown. The short-hair cutting device 5 comprises an arched shear foil 6 and a lamellar cutter 43 which is pressed into the space bounded by the arched shear foil 6 by means of two springs 41 and 42. The lamellar cutter 43 comprises a multitude of lamellae 44 formed by steel blades and embedded in a plastic lamella support 45. The lamella support 45 is supported by a cutter holder 16.

The shear foil 6 forms a stationary first cutter and the lamellar cutter 14 forms a reciprocatingly drivable second cutter. A reciprocatingly drivable drive member 19 serves to drive the lamellar cutter 43 and is formed by, for example, the drive member of reciprocatingly drivable known vibratory bridge. A hinge device 20 between the drive member 19 and the lamellar cutter 43 also comprises two limbs 21 and 22 which are oppositely inclined relative to the pressing direction 15 and which are each connected to the drive member 19 and the lamellar cutter 43 by hinges 23 and 24 and hinges 25 and 26, respectively. The two connecting lines 27 and 28 through the two hinges 23, 25 and 24, 26 of each of the limbs 21 and 22, respectively, intersect one another essentially in the area of the point of application 29 of the resultants of the frictional forces between the two cutters 6 and 46. The point of application of the resultants of the cutting forces between the two cutters 6 and 43 and the point of application of the resultants of the inertial forces of the lamellar cutter 43 and the cutter holder 16 are also situated in the area of the point of application 29 of the resultants of the frictional forces. Owing to the arched shape of shear foil 6 and the lamellae 44 of the lamellar cutter 43 the point of application 29 is situated at a given distance from the apex of the arched shear foil 6, the frictional forces and the cutting forces being distributed over the arcuate zone of the shear foil 6 and the lamellae 44 of the lamellar cutter 43.

In a shaving apparatus comprising a short-hair cutting device 5 as shown in FIGS. 4 and 5 the driving force is transmitted to the drivable lamellar cutter 43 by the drive member 19, as a result the application of this driving force in the manner described above, while no unfavourable torque effects act on the lamellar cutter 43 and lift the lamellae of the lamellar cutter 43 off the contact face of the shear foil 6, so that always a satisfactory and close engagement between the shear foil 6 and the lamellae 44 of the lameliar cutter 43 is guaranteed. By means of the special construction of the hinge device 20, the driving force exerted on the lamellar cutter 43 by the drive member 19 can be situated almost exactly in the area of the point of application 29 of the resultants of the frictional forces between the two cutters 6 and 43, of the resultants of the cutting forces between the two cutters 6 and 43, and of the resultants of the inertial forces of the lamellar cutter 43 and of the cutter holder 16.

The invention is not limited to the two exemplary embodiments described above. The steps in accordance with the invention may, for example, also be applied to so-called beard trimmers which have a toothed cutting device in the upper part of a substantially bar-shaped housing and which may also have an additional toothed cutting device at a side wall.

We claim:

1. A hair-cutting apparatus (1) having a first cutter (10; 6) and second cutter (12; 43) which is reciprocatingly drivable parallel to a driving direction (14), the first cutter (10; 6) and the second cutter (12; 43) being urged against one another parallel to a pressing direction (15), having a reciprocatingly drivable drive member (19) for driving the second cutter (12; 43), and having a hinge device (20) between the drive member (19) and the second cutter (12; 43), via which hinge device a driving force can be transmitted from the drive member (19) to the second cutter (12; 43), substantially in the area of the point of application (29) of the resultants of the frictional forces between the two cutters (10, 12; 6, 43), wherein the hinge device (20) comprises two limbs (21, 22) which are oppositely inclined relative to the pressing direction (15) and which are each connected to the drive member (19) and the second cutter (12; 43) by hinges (23, 24; 25, 26), and wherein the two connecting lines (27, 28) through the two hinges (23, 25, 24, 26) of each of the limbs (21, 22) intersect one another substantially in the area of the point of application (29) of the resultants of the frictional forces between the two cutters (10, 12; 6, 43).

2. An apparatus as claimed in claim 1, in which the second cutter (12; 43) has a cutter holder (16), wherein the cutter holder (16) and the two limbs (21, 22) as well as the drive member (19) form an integral plastics part and the hinges (23, 24, 25, 26) are integral hinges.

3. An apparatus as claimed in claim 2, wherein, in addition to being reciprocatingly movable, the drive member (19) is also mounted to be movable parallel to the pressing direction (15) and is urged towards the first cutter (10) by means of at least one spring (17).

4. An apparatus as claimed in claim 3, wherein the spring (17) acts on the cutter holder (16) and on a stationary bearing element (18).

5. An apparatus as claimed in claim 3, wherein the drive member (19) is formed by a drive lever which is pivotable relative to a stationary bearing element (30) by means of a pivotal bearing device (31), and the pivotal bearing device (31) comprises a further limb (34) which extends substantially perpendicularly to the pressing direction (15) and which is pivotally connected to a part (33) of the stationary bearing element (30) and to the drive lever (19) via a hinge (35, 36).

6. An apparatus as claimed in claim 5, wherein the drive lever (19) and the further limb (34) as well as the part (33) of the stationary bearing element (30) form an integral plastics part and the two hinges (35, 36) are integral hinges.

7. An apparatus as claimed in claim 4, wherein the drive member (19) is formed by a drive lever which is pivotable relative to a stationary bearing element (30) by means of a pivotal bearing device (31), and the pivotal bearing device (31) comprises a further limb (34) which extends substantially perpendicularly to the pressing direction (15) and which is pivotally connected to a part (33) of the stationary bearing element (30) and to the drive lever (19) via a hinge (35, 36).

* * * * *